United States Patent [19]

Chan et al.

[11] Patent Number: 4,886,726

[45] Date of Patent: Dec. 12, 1989

[54] GLYCERIDES AS CHARGE DIRECTORS FOR LIQUID ELECTROSTATIC DEVELOPERS

[75] Inventors: Dominic M. Chan, Wilmington, Del.; Lyla M. El-Sayed, West Chester; Chandrakant B. Thanawalla, Exton, both of Pa.; Torence J. Trout, Wilmington, Del.

[73] Assignee: E. I. Du Pont de Nemours and Company, Wilmington, Del.

[21] Appl. No.: 125,503

[22] Filed: Nov. 25, 1987

[51] Int. Cl.[4] ..... G03G 9/12

[52] U.S. Cl. ..... 430/115; 430/137

[58] Field of Search ..... 430/115, 119, 137

[56] References Cited

U.S. PATENT DOCUMENTS

| | | | |
|---|---|---|---|
| 4,014,865 | 3/1977 | Gilliams et al. | 252/62.1 |
| 4,160,773 | 7/1979 | Eibl et al. | 558/92 |
| 4,161,453 | 7/1979 | Gilliams et al. | 430/115 |
| 4,331,755 | 5/1982 | Gilliams et al. . | |
| 4,425,418 | 1/1984 | Iwaki et al. | 430/106 |
| 4,734,352 | 3/1988 | Mitchell | 430/115 |
| 4,780,389 | 10/1988 | El-Sayed | 430/115 |

FOREIGN PATENT DOCUMENTS

| | | |
|---|---|---|
| 57-210345 | 12/1982 | Japan . |
| 58-194040 | 11/1983 | Japan . |
| 61-284776 | 12/1986 | Japan . |
| 1151141 | 5/1969 | United Kingdom . |

*Primary Examiner*—John L. Goodrow

[57] ABSTRACT

Electrostatic liquid developer consisting essentially of (A) nonpolar liquid having Kauri-butanol value less than 30, present in major amount, (B) at least one thermoplastic resin having an average particle size by area of less than 10 μm, and (C) at least one glyceride charge director as defined. Optionally a colorant and a charge adjuvant can be present. The elastrostatic liquid developer is useful in copying, making proofs, including digital color proofs, lithographic printing plates, resists and medical hardcopies.

53 Claims, No Drawings

GLYCERIDES AS CHARGE DIRECTORS FOR LIQUID ELECTROSTATIC DEVELOPERS

DESCRIPTION

1. Technical Field

This invention relates to liquid electrostatic developers. More particularly this invention relates to electrostatic liquid developers containing glycerides as charge directors.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters a low dielectric constant below 3.0, and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, metallic soaps, an aromatic hydrocarbon, etc. to the liquid toner comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor solid area coverage, and/or image squash. In order to overcome such problems much research effort has been expended to develop new type charge directors and/or charging adjuvants for electrostatic liquid toners.

It has been found that the above disadvantages can be overcome and improved developers containing a dispersant nonpolar liquid, a thermoplastic resin, and preferably a colorant and an adjuvant, can be prepared by the addition of a glyceride charge director compound. The improved electrostatic liquid developers when used to develop an electrostatic image result in improved image quality, reduced squash, and improved solid area coverage. Both positive and negative liquid developers can be obtained depending on the resins, pigments, and/or adjuvant used.

SUMMARY OF THE INVENTION

In accordance with this invention there is provided an improved electrostatic liquid developer consisting essentially of (A) a nonpolar liquid having a Kauri-butanol value of less than 30, present in a major amount, (B) at least one thermoplastic resin having an average by area particle size of less than 10 μm, and (C) at least one glyceride charge director of the formula:

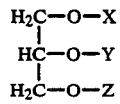

wherein each of X, Y and Z, which can be the same or different, is

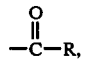

wherein R is alkyl, substituted alkyl, alkylene, or substituted alkylene, wherein alkyl or alkylene contains 1 to 100 carbon atoms.

In accordance with an embodiment of this invention there is provided an improved electrostatic liquid developer consisting essentially of (A) a nonpolar liquid having a Kauri-butanol value of less than 30, present in a major amount, (B) at least one thermoplastic resin having an average by area particle size of less than 10 μm, and (C) a glyceride charge director selected from the group consisting of a compound represented by the formulae:

(1) 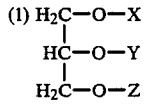

wherein at least one of X, Y and Z, is

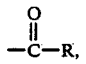

wherein R is alkyl, substituted alkyl, alkylene, or substituted alkylene, wherein alkyl or alkylene contains 1 to 100 carbon atoms, and at least one of X, Y and Z is selected from the group consisting of the free acid form, partially neutralized salt of the free acid, fully neutralized salt of the free acid, mono- or diester of the free acid,

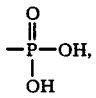

and combinations thereof;

(2) free acid form, partially neutralized salt of the free acid, fully neutralized salt of the free acid, or ester of the free acid,

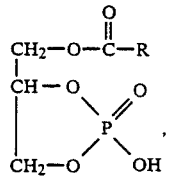

wherein R is defined as in (1) above;

(3) free acid form, partially neutralized salt of the free acid, fully neutralized salt of the free acid, or ester of the free acid,

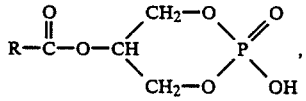

wherein R is defined as in (1) above; and mixtures of said glycerides.

In accordance with a still another embodiment of this invention there is provided a process for preparing electrostatic liquid developer for electrostatic imaging comprising (A) dispersing at an elevated temperature in a vessel a thermoplastic resin, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) a least one glyceride charge director as described in the formulae set out above.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., polyhydroxy compound, aminoalcohol, polybutylene succinimide, aromatic hydrocarbon, metallic soap, etc.

Squash means the blurred edges of the image.

Grey scale means a step wedge where the toned image density increases from $D_{min}$ to $D_{max}$ in constant increments.

Partially neutralized with respect to the charge director means that sufficient base has been added to neutralize a fraction of the acidic protons on the phosphate groups.

Fully neutralized with respect to the charge director means that sufficient base has been added to neutralize all of the acidic protons on the phosphate groups.

Acid number is the milligrams of potassium hydroxide required to neutralize 1 gram of sample.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar®12 | 69 | 204 |
| Norpar®13 | 93 | 210 |
| Norpar®15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.98% by weight, preferably 95 to 99.9% by weight, based on the total weight of liquid developer. The total weight of solids in the liquid developer is 0.02 to 15%, preferably 0.1 to 5.0% by weight depending on process parameters, e.g., development time, length of development zone, process speed, etc. The total weight of solids in the liquid developer is based on the resin, including components dispersed therein, and any pigment component present.

Useful thermoplastic resins or polymers (B) include: ethylene vinyl acetate (EVA) copolymers (Elvax® resins, E. I. du Pont de Nemours and Company, Wilmington, DE), copolymers of ethylene and an α,β-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford CN; ethylene vinyl acetate resins. e.g., DQDA 6479 Natural and DQDA 6832 Natural 7 also sold by Union Carbide Corp.; Surlyn® ionomer resin by E I. du Pont de Nemours and Company, Wilmington, DE, polyester, polyvinyl toluene, polyamide, styrene/butadiene copolymers, epoxy resins, acrylic resins, such as a copolymer of acrylic or methacrylic acid (optional but preferred) and at least one alkyl ester of acrylic or methacrylic acid wherein alkyl is 1 to 20 carbon atoms, e.g., methyl acrylate(50 to 90%)/methacrylic acid(0 to 20%)/ethylhexyl acrylate(10 to 50%); and other acrylic resins including Elvacite® Acrylic Resins, E. I. du Pont de Nemours and Company, Wilmington, DE, or blends of the resins. Preferred copolymers are the copolymers of ethylene and an $\alpha,\beta$-ethylenically unsaturated acid selected from the group consisting of acrylic acid and methacrylic acid. The synthesis of copolymers of this type are described in Rees U.S. Pat. No. 3,264,272, the disclosure of which is incorporated herein by reference. For the purpose of preparing the preferred copolymers, the reaction of the acid containing copolymer with the ionizable metal compound, as described in the Rees Patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, preferred resins have the following preferred characteristics:

1. Be able to disperse the colorant, e.g., pigment, metallic soap, etc.,

2 Be substantially insoluble in the dispersant liquid at temperatures below 40° C., so that the resin will not dissolve or solvate in storage, 3. Be able to solvate at temperatures above 50° C., 4. Be able to be ground to form particles between 0.1 μm and 5 μm, in diameter (preferred size), e.g., determined by Horiba CAPA-500 centrifugal particle analyzer; and between 1 μm and 15 μm in diameter, e.g., determined by Malvern 3600E described below, 5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and about 30 μm average particle size, e.g., determined by Malvern 3600E Particle Sizer as described below, and 6. Be able to fuse at temperatures in excess of 70° C. By solvation in 3. above, the resins forming the toner particles will become swollen, gelatinous, or softened.

The glyceride charge directors (C) of the invention which can be used to make positively and negatively charged liquid electrostatic developers depending on the resins pigments and/or adjuvants that may be present are represented by the formulae:

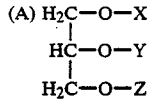

wherein each of X, Y and Z, which can be the same or different, is

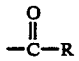

wherein R is alkyl, substituted alkyl e.g., halogen, e.g., Cl , Br, I, F; alkoxy of 1 to 12 carbon atoms, preferably 1 to 6 carbon atoms, alkylene or substituted alkylene, e.g., halogen, e.g., Cl , Br, I, F; alkoxy of 1 to 12 carbon atoms, preferably 1 to 6 carbon atoms, wherein alkyl or alkylene contains 1 to 100 carbon atoms preferably 5 to 35 carbon atoms;

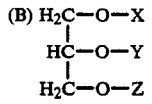

wherein at least one of X, Y and Z is

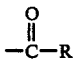

wherein R is as defined above in (A), and at least one of X, Y and Z is selected from the group consisting of the free acid form, partially neutralized salt of the free acid, fully neutralized salt of the free acid, mono- or diester of the free acid,

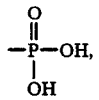

and combinations thereof;

(C) free acid form, partially neutralized salt of the free acid, fully neutralized salt of the free acid, or ester of the free acid,

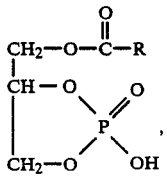

wherein R is defined as in (A) above;

(D) free acid form, partially neutralized salt of the free acid, fully neutralized salt of the free acid, or ester of the free acid,

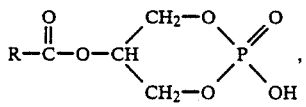

wherein R is defined as in (A) above; and mixtures of said glycerides.

Useful glyceride charge directors represented by the general formulae (A) to (D) above include: Emphos® D70-30C and Emphos® F27-85, two commercial products sold by Witco Chemical Co., New York. NY; which are sodium salts of phosphated mono- and diglycerides with unsaturated and saturated acid substituents, respectively; triglycerides wherein X, Y or Z can be residue(s) of acids having a range of 1 to 100 carbon atoms, preferably 5 to 35 carbon atoms. Included among such acids, for example, are:

caproic acid,
caprylic acid,
myristic acid,
arachidic acid
cerotic acid
sorbic acid,
linolenic acid
linoleic acid,
behenic acid, etc. In formulae (B), (C), and (D) above, at least one X, Y and Z can be a phosphoric radical in the form of free acid or partially or fully neutralized salt of a mono, di, tri or tetravalent metal ion, ammonium ion, or substituted ammonium ion, e.g., Na, K, Li, Zn, Ba, Ca, Al, Fe, Co, Ti, $NH_4$ and $N(R)_4$ where R can be alkyl having 1 to 20 carbon atoms or aryl having 6 to 10 carbon atoms, etc., or the mono- or diester of the free acid wherein one or both acid radicals can be substituted with an alkyl or alkylene radical of from 1 to 35 carbon atoms, which can be the same or different in the event of the diester. Combinations of the above substituents can also be present, e.g., salt and ester combination, etc. Up to 95% by weight, preferably up to 50% by weight, based on the total weight of charge director (C) of a triglyceride of the formula:

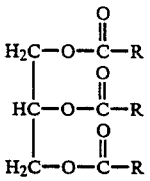

wherein R, which can be the same or different, is alkyl, substituted alkyl, alkylene, or substituted alkylene, wherein alkyl or alkylene contains 1 to 100 carbon atoms, can be present. The charge director is present in 0.1 to 10,000 milligrams per gram of developer solids, preferably 1 to 1000 milligrams per gram of developer solids. The charge director preferably should have sufficient solubility in the nonpolar liquid to allow interaction with and charging of the toner particles.

As indicated above, an additional component that can be present in the electrostatic liquid developer is a colorant, such as a pigment or dye and combinations thereof, which is preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black Pigment C.I. No. 77266) and Sterling® NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

Another additional component of the electrostatic liquid developer is an adjuvant which, for example, includes polyhydroxy compound which contains at least 2 hydroxy groups, aminoalcohol, polybutylene succinimide, metallic soap, aromatic hydrocarbon having a Kauri-butanol value of greater than 30, etc. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol glycerol, pentaerythritol, glycerol-tri-12 hydroxystearate, ethylene glycol monohydroxystearate, propylene glycol monohydroxystearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene/succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

metallic soap: aluminum tristearate; aluminum distearate; barium, calcium, lead, and zinc stearates; cobalt, manganese lead, and zinc linoleates; aluminum calcium and cobalt octoates; calcium and cobalt oleates; zinc palmitate; calcium, cobalt, manganese, lead, and zinc naphthenates; calcium, cobalt, manganese, lead, and zinc resinates; etc. The metallic soap is dispersed in the thermoplastic resin as described in Trout, U.S. Pat. No. 4,707,429, the disclosure of which is incorporated herein by reference.

aromatic hydrocarbon benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc.

The particles in the electrostatic liquid developer have an average by area particle size of less than 10 μm, preferably the average by area particle size is less than 5 μm. The resin particles of the developer may or may not be formed having a plurality of fibers integrally extending therefrom. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed at least one thermoplastic resin, and dispersant polar liquid described above. Generally the resin, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., up to 100% based on the weight of polar additive and dispersant nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant, if present, decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the group consisting of stainless steel, carbon steel, alumina, ceramic, zirconium, silica, and sillimanite. Carbon steel particulate media are particularly useful when colorants other than black are used. A typical diameter range for the particulate media is in the range of 0.04 to 0.5 inch (1.0 to approx. 13 mm).

After dispersing the ingredients in the vessel, with or without a polar additive present until the desired dispersion is achieved, typically 1 to 2 hours with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic developers to facilitate grinding or to dilute the developer to the appropriate % solids needed for toning. Additional liquid means dispersant nonpolar liquid, polar liquid, or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during cooling. Toner particles of average particle size (by area) of less than 10 μm, as determined by a Horiba CAPA-500 centrifugal particle analyzer described above or other comparable apparatus, are formed by grinding for a relatively short period of time.

Another instrument for measuring average particles sizes is a Malvern 3600E Particle Sizer manufactured by Malvern, Southborough, MA which uses laser diffraction light scattering of stirred samples to determine average particle sizes. Since these two instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 + 3.4 |
| 20 | 6.4 + 1.9 |
| 15 | 4.6 + 1.3 |
| 10 | 2.8 + 0.8 |
| 5 | 1.0 + 0.5 |
| 3 | 0.2 + 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion may be reduced by the addition of additional dispersant nonpolar liquid as described previously above. The dilution is normally conducted to reduce the concentration of toner particles to between 0.02 to 15 percent by weight, preferably 0.1 to 5.0, and more preferably 0.1 to 2 weight percent with respect to the dispersant nonpolar liquid. One or more glyceride charge director compounds (C), of the type set out above, can be added to impart a positive or negative charge, as desired. The addition may occur at any time during the process; preferably at the end of the process, e.g., after the particulate media, if used, are removed and the desired concentration of toner particles is achieved. If a diluting dispersant nonpolar liquid is also added,. the glyceride compound can be added prior to, concurrently with, or subsequent thereto. If an adjuvant compound of a type described above has not been previously added in the preparation of the developer, it can be added prior to or subsequent to the developer being charged.

Other process embodiments for preparing the liquid electrostatic developer include:

(A) dispersing in a thermoplastic resin a colorant and/or adjuvant in the absence of a dispersant nonpolar liquid having a Kauri-butanol value of less than 30 to form a solid mass.

(B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) optionally adding additional nonpolar liquid, polar liquid or combinations thereof to reduce the concentration of toner particles to between 0.02 to 15.0 percent by weight with respect to the liquid; and (F) adding to the dispersion during any of steps (C) to (E) or subsequent to step (E) a glyceride charge director as described above; and (A) dispersing in a thermoplastic resin a colorant and/or adjuvant in the absence of a dispersant nonpolar liquid having a Kauri-butanol value of less than 30 to form a solid mass, (B) shredding the solid mass, (C) dispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and colorant decomposes, (D) cooling the dispersion, either (1) without stirring to form a gel or solid mass, followed by shredding the gel or solid mass and grinding by means of particulate media, optionally in the presence of additional liquid;

(2) with stirring to form a viscous mixture and grinding by means of particulate media, optionally in the presence of additional liquid; or (3) while grinding by means of particulate media to prevent the formation of a gel or solid mass, optionally in the presence of additional liquid;

(E) separating the dispersion of toner particles having an average by area particle size of less than 10 μm from the particulate media, and (F) optionally adding additional nonpolar liquid, polar liquid or combinations thereof to reduce the concentration of toner particles to between 0.02 to 15.0 percent by weight with respect to the liquid; and (G) adding to the dispersion during any of steps (C) to (F) or subsequent to step (F) a glyceride charge director as described above.

INDUSTRIAL APPLICABILITY

The glyceride charge directors of this invention are capable of charging electrostatic liquid developers both positively and negatively depending on the resins, pigments and/or adjuvants that may be present. The electrostatic liquid developers demonstrate improved image quality, resolution, solid area coverage, and toning of fine details, evenness of toning, reduced squash independent of the pigment present. In addition, the developers of the invention demonstrate reduced sensitivity to high humidity, e.g., 70% or more, compared to other known charge directors such as lecithin. The developers of this invention are useful in copying, e.g., making office copies of black and white as well as various colors; or color proofing, e.g., a reproduction of an image using the standard colors: yellow, cyan, magenta and black, as desired. In copying and proofing the toner particles are applied to a latent electrostatic image. Other uses envisioned for the electrostatic liquid developers include: digital color proofing, lithographic printing plates, resists, and medical hardcopies.

EXAMPLES

The following controls, procedure and examples wherein the parts and percentages are by weight illustrate, but do not limit, the invention. In the examples the melt indices were determined by ASTM D 1238, Procedure A, the average particle sizes by area were determined by a Horiba CAPA-500 centrifugal particle analyzer or a Malvern Particle sizer as described above Amoco 9040 is an alkylhydroxybenzylpolyamine sold as 45% surfactant, 30% aromatic hydrocarbon, and oil having a number average molecular weight of about 1600 to 1800, by Amoco Additives Company, Clayton, MO; number average molecular weight can be determined by known osmometry techniques, weight average molecular weight can be determined by gel permeation chromatography (GPC). Those charge directors prepared as described in the examples below were not purified and may contain minor amounts of by products of the reaction.

CONTROL 1

In a Union Process 1S Attritor, Union Process Company, Akron, Ohio, was placed the following ingredients:

| INGREDIENT | AMOUNT (g) |
|---|---|
| Copolymer of ethylene (89%) and methacrylic acid (11%): melt index at 190° C. is 100, acid number is 66 | 200.00 |
| Heucophthal Blue ® XBT-585D (Heubach Inc., Newark) | 13.86 |
| Dalamar ® Yellow YT-839D (Heubach Inc., Newark, NJ) | 0.14 |
| Isopar ®-L (Exxon Corp.) | 1000.00 |

The ingredients were heated to 90° C. to 110° C. and milled at a rotor speed of 230 rpm with 0.1875 inch (4.76 mm) diameter stainless steel balls for 2 hours. The attritor was cooled to 42° C. to 50° C. while milling was continued and then 700 grams of Isopar ®-H (Exxon Corp.) were added. Milling was continued for 21 hours and the average particle size was monitored. The particulate media were removed and the toner was diluted to 2% solids with additional Isopar ®-L and charged with 150 mg Basic Barium Petronate ® (Witco Chemical Co., New York, NY)/g of developer solids. Image quality was determined using a Savin 870 copier in a standard mode: Charging corona set at +6.8 kV and transfer corona set at +8.0 kV using carrier sheets such as Plainwell offset enamel paper number 3 class 60 lbs text. Image quality, after development and transfer, indicated a poor negative toner with poor resolution, poor solid area coverage, and high squash. Results are found in Table 1 below.

CONTROL 2

The procedure of Control 1 was repeated with the following exceptions: the toner was charged with 30 mg of lecithin/gram of developer solids. Milling was continued for 19 hours. Image quality, after development and transfer, indicated a very poor negative toner with poor resolution, poor solid area coverage, and high squash. Results are found in Table 1 below.

CONTROL 3

The procedure of Control 1 was repeated with the following exceptions: instead of the yellow pigment, 27.4 grams of Sterling®NS Carbon Black, Cabot Corp., Carbon Black Division, Boston, MA, pigment were used and 0.6 gram of Heucophthal Blue®XBT-585D, Heubach Inc., Newark, NJ, was used instead of 13.86 grams. In addition, 2.2 grams of aluminum stearate S, Witco Chemical Co., New York, NY, were added. 1700 grams of Isopar®-L were added prior to hot dispersion step and Isopar®-L was not added after cooling. The toner was cold ground for 19 hours resulting in a final Malvern average particle size of 5.3 μm. Toner was diluted to 2% solids and charged with 30 mg lecithin per gram of toner solids. Image quality, after development and transfer indicated a very good negative toner with good resolution, good solid area coverage, low squash and good transfer efficiency. Results are found in Table 1 below.

EXAMPLE 1

The procedure for Control 1 was repeated with the following exceptions: a 10% solution of Emphos® D70-30C glyceride, Witco Chemical Co., New York, NY was prepared in Isopar®-L. The developer was charged by adding 400 mg of the Emphos® D70-30C per gram of developer solids instead of Basic Barium Petronate®. Image quality showed evidence of a very good positive toner with strong reverse toning with good resolution and squash. Results are found in Table 1 below.

EXAMPLE 2

The procedure of Control 1 was repeated with the following exceptions: a 10% solution of Emphos® F27-85 glyceride, Witco Chemical Co., New York, NY was prepared in Isopar®-L. The developer was charged by adding 200 mg of the Emphos® D27-85 per gram of developer solids instead of Basic Barium Petronate®. Image quality showed evidence of a good positive toner with strong reverse toning with good resolution and squash. Results are found in Table 1 below.

EXAMPLE 3

The procedure of Control 3 was repeated with the following exceptions: a 10% solution of Emphos® D70-30C described in Control 1 was prepared in Isopar®-L. The developer was charged by adding 200 mg/g of Emphos® D70-30C per gram of developer solids instead of lecithin. Image quality showed evidence of a very good negative toner with good resolution, solids, transfer efficiency, and squash. Results are found in Table 1 below.

TABLE 1

| Example or Control | Charge Director | Amount (mg/g) | Polarity | Image Quality |
|---|---|---|---|---|
| Control 1 | Basic Barium Petronate® | 150 | − | Poor |
| Control 2 | lecithin | 30 | − | V. Poor |
| Control 3 | lecithin | 30 | − | V. Good |
| Ex. 1 | Emphos® D70-30C | 400 | + | V. Good |
| Ex. 2 | Emphos® F27-85 | 200 | + | Good |
| Ex. 3 | Emphos® D70-30C | 200 | − | V. Good |

CONTROL 4

| Ingredients | Amount (lbs) |
|---|---|
| Terpolymer of Methyl acrylate (67.3%) methacrylic acid (3.1%), and ethylhexyl acrylate (29.6%) weight average molecular weight of 172,000 acid no. is 13 | 11.8 |
| Uhlich BK 8200, laked Carbon Black Paul Uhlich & Co., Inc., Hastings-On-Hudson, NY | 2.4 |
| Isopar®-L, nonpolar liquid having a Kauri-butanol value of 27, Exxon Corp. | 100.0 |

The ingredients were heated to 120° C.±20° C. in a Union Processing 30 S attritor, Union Process Company, Akron, Ohio, and milled with 0.1875 inch (4.75 mm) diameter stainless steel balls for two hours. The attritor was cooled to 65° C. while the milling was continued and 1.7 pounds of Amoco 9040 were added. The attritor continued to cool to room temperature while milling was continued. Milling was continued for an additional 17 hours to obtain particles of 0.47 μm by area determined using the Horiba CAPA-500 centrifugal particle size analyzer. The particulate media were removed and the dispersion of toner particles was then diluted to 0.5 percent solids with additional Isopar®-L and charged with 24 milligrams of iron naphthenate per gram developer solids. The developer was evaluated by means of a photoconducting film, e.g., such as are described in Mattor U.S. Pat. No. 3,314,788 and Paulin et al. U.S. Pat. No. 4,248,952, the disclosures of which are incorporated herein by reference, and which has a base support, such as 0.007 (0.18 mm) polyethylene terephthalate, bearing two layers, the outer layer being an organic photoconductive layer, and the inner layer next to the support being an electrically conductive layer such as aluminum, a portion of the outer layer being removed along at least one edge thereof to define a strip of the conductive layer and on the exposed strip a conductive paint was placed so as to permit the conductive layer to be grounded. The photoconducting film used was passed over a negative 1100 V scorotron at 0.5 inch/second (1.27 cm/second), discharging selectively using a cathode ray tube, and toning with the developer was accomplished using a developer-filled gap between a 350 V development electrode and the charged film. The resultant images were then fused in an oven at 115° C. for 1 minute and cooled. Image quality was poor. Images were under-toned, blurry and showed poor grey scale.

CONTROL 5

The developer was made as described in Control 4 except that the developer was charged with 133 milligrams of Basic Barium Petronate® per gram of toner solids instead of iron naphthenate. The developer was evaluated as described in Control 4. The images showed reverse toning indicating the developer was negatively charged.

PROCEDURE 1

The free acid form of phosphoglyceryl dioleate charge director was made as follows:

In a 300 ml flask equipped with a stirrer was placed 5.0 g (0.033 mol) of phosphorus oxychloride and 20 ml of toluene. The reaction mixture was cooled to 0° C. with stirring under nitrogen and a solution of 18.0 g (0.029 mole) of glyceryl dioleate, 5.0 g (0.049 mole) of triethylamine, 0.2 g of 4-dimethylaminopyridine in 70 ml of toluene was added dropwise over 15 minutes. The white reaction slurry was stirred at room temperature under nitrogen for 6.5 hours and partitioned between 250 ml of pentane and 200 ml of saturated aqueous sodium chloride solution. The layers were separated and the aqueous layer extracted with 50 ml of hexane. The combined organic layers were dried over anhydrous magnesium sulphate, filtered, and the solvent was removed by rotary evaporation to give 17.8 g of thick orange oil. The n.m.r. spectra of the product were found consistent with the product being substantially the acid form of glycol dioleate phosphate.

EXAMPLE 4

0.3 gram of the free acid form of phosphoglyceryl dioleate prepared as described in Procedure 1 was diluted to 30 milliliters with Isopar ®-L. A developer was made as described in Control 4 except that 20 grams of this solution were added to 1500 grams of the developer instead of iron naphthenate. The developer was evaluated as described in Control 4. Image quality was good. Images showed good resolution and good grey scale with very little background toning.

EXAMPLE 5

0.3 gram of the free acid form of phosphoglyceryl dioleate prepared as described in Procedure 1 was mixed with 0.1 gram of sodium carbonate in a vortex mixer and slowly diluted to a total volume of 30 ml with Isopar ®-L. The developer was made as described in Control 4 except that 20 grams of the resulting solution of the sodium salt of phosphoglyceryl dioleate were added to 1500 grams of the developer instead of iron naphthenate. The developer was evaluated as described in Control 4. Image quality was good: Images showed good resolution and good grey scale with very little background toning.

EXAMPLE 6

0.3 gram of the free acid form of phosphoglyceryl dioleate prepared as described in Procedure 1 was mixed with 0.15 gram of barium hydroxide octahydrate in a vortex mixer and slowly diluted to a total volume of 30 ml with Isopar ®-L. The developer was made as described in Control 4 except that 20 grams of the resulting solution of the barium salt of phosphoglyceryl dioleate were added to 1500 grams of the developer instead of iron naphthenate. The developer was evaluated as described in Control 4. Image quality was very good. Images showed good resolution and good grey scale with no background toning.

EXAMPLE 7

0.3 gram of the free acid form of phosphoglyceryl dioleate prepared as described in Procedure 1 was mixed with 0.1 g of N,N-dimethylaniline in a vortex mixer and slowly diluted to a total volume of 30 ml with Isopar ®-L. The developer was made as described in Control 4 except that 20 grams of the resulting solution of the dimethyl aniline salt of phosphoglyceryl dioleate were added to 1500 grams of the developer instead of iron naphthenate. The developer was evaluated as described in Control 4. Image quality was good. Images showed good resolution and good grey scale with very little background toning.

EXAMPLE 8

0.3 gm of the free acid form of phosphoglyceryl dioleate prepared as described in Procedure 1 was mixed with 3 drops of aqueous ammonia in a vortex mixer and slowly diluted to a total volume of 30 ml with Isopar ®-L. The developer was made as described in Control 4 except that 20 grams of the resulting solution of the ammonium salt of phosphoglyceryl dioleate were added to 1500 grams of the developer instead of iron naphthenate. The developer was evaluated as described in Control 4. Image quality was good. Images showed good resolution and good grey scale with very little background toning.

EXAMPLE 9

0.3 gm of the free acid form of phosphoglyceryl dioleate prepared as described in Procedure 1 was mixed with 0.5 ml of 1 M tetrabutyl ammonium hydroxide in methanol in a vortex mixer and slowly diluted to a total volume of 30 ml with Isopar ®-L. The developer was made as described in Control 4 except that 20 grams of the resulting solution of the tetrabutyl ammonium salt of phosphoglyceryl dioleate were added to 1500 grams of the developer instead of iron naphthenate. The developer was evaluated as described in Control 4. Image quality was good. Images showed good resolution and good grey scale with very little background toning.

EXAMPLE 10

0.3 gm of the free acid form of phosphoglyceryl dioleate prepared as described in Procedure 1 was mixed with 0.12 ml of triethylamine in a Vortex mixer and slowly diluted to a total volume of 30 ml with Isopar ®-L. The developer was made as described in Control 4 except that 20 grams of the resulting solution of the trimethylamine salt of phosphoglyceryl dioleate were added to 1500 grams of the developer instead of iron naphthenate. The developer was evaluated as described in Control 4. Image quality was good. Images showed good resolution and good grey scale with very little background toning.

EXAMPLE 11

The acid form of glycerol monooleate cyclicphosphate was made as follows: to a suitable reaction vessel, equipped with an agitator, thermometer, nitrogen inlet, condenser and an addition funnel, was charged 89.4 parts (0.25 mole) of glycerol monooleate, 30.3 parts (0.3 mole) of triethylamine, and 200 parts of methylene chloride. The reaction mass was cooled to 0° C. with stirring under nitrogen and 38.4 parts (0.25 mole) of phosphorus oxychloride were added dropwise to it over 90 minutes. Following the addition, the warmed up reaction was refluxed for 4 hours and cooled. The reaction mixture was washed twice with 300 parts of water, dried over anhydrous magnesium sulfate and filtered. The filtrate, on evaporation of the solvent, gave 87.6 parts of a dark straw-colored oil. The infrared and n.m.r. spectra of the product were found consistent with the product being substantially the acid form of glycerol monooleate cyclicphosphate. The developer was made as described in Control 4 except that 20 grams of a 1.4% solution of the resulting acid form of glycerol monooleate cyclicphosphate in Isopar®-L were added to 1500 grams of the developer instead of iron naphthenate. The developer was evaluated as described in Control 4. Image quality was good. Images showed good resolution and good grey scale with very little background toning.

EXAMPLE 12

A mixture of 2.0 parts of the acid form of gylcerol monooleate cyclicphosphate, 0.6 part of sodium bicarbonate, and 18.0 parts of Isopar®-L was agitated vigorously and allowed to stand overnight. Following centrifugation of the mixture, the clear supernatant Isopar®-solution contained predominantly the sodium salt of glycerol monooleate diphosphate. The developer was made as described in Control 4 except that 20 grams of a 1.4% solution of the resulting solution of the sodium salt of glycerol monooleate diphosphate in Isopar®-L were added to 1500 grams of the developer instead of iron naphthenate. The developer was evaluated as described in Control 4. Image quality was good. Images showed good resolution and good grey scale with very little background toning.

EXAMPLE 13

A developer was made as described in Control 4 except that the developer was charged with 37 milligrams of glyceryl trioleate, K&K Laboratories, Plainview, NY, per gram of toner solids instead of iron naphthenate. The developer was evaluated as described in Control 4. Image quality was satisfactory. Images showed satisfactory grey scale with some background toning.

The image quality results of Examples 4 to 13 and Controls 4 and 5 are summarized in Table 2 below.

TABLE 2

| Example or Control | Charge Director | Polarity | Image Quality |
|---|---|---|---|
| Control 4 | iron naphthenate | + | Poor |
| Control 5 | Basic Barium Petronate ® | − | Reverse |
| Ex. 4 | phosphoglyceryl dioleate, free acid | + | Good |
| Ex. 5 | Na salt of Example 4 acid | + | Good |
| Ex. 6 | Ba salt of Example 4 acid | + | Very Good |
| Ex. 7 | N,N—dimethylaniline salt of Example 4 acid | + | Good |
| Ex. 8 | ammonium salt of Example 4 acid | + | Good |
| Ex. 9 | tetrabutyl ammonium salt of Example 4 acid | + | Good |
| Ex. 10 | triethylamine salt of Example 4 acid | + | Good |
| Ex. 11 | glycerol monooleate cyclicphosphate, free acid | + | Good |
| Ex. 12 | Na salt of Example 11 acid | + | Good |
| Ex. 13 | glycerol trioleate | + | Satisfactory |

We claim:

1. An improved electrostatic liquid developer consisting essentially of (A) a nonpolar liquid having a Kauri-butanol value of less than 30, present in a major amount, (B) at least one thermoplastic resin having an average by area particle size of less than 10 μm, and (C) at least one glyceride charge director of the formula:

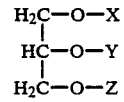

wherein each of X, Y and Z, which can be the same or different, is

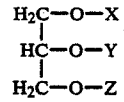

wherein R is alkyl, substituted alkyl, alkylene, or substituted alkylene, wherein alkyl or alkylene contains 1 to 100 carbon atoms.

2. An improved electrostatic liquid developer consisting essentially of (A) a nonpolar liquid having a Kauri-butanol value of less than 30, present in a major amount, (B) at least one thermoplastic resin having an average by area particle size of less than 10 μm, and (C) a glyceride charge director selected from the group consisting of a compound represented by the formulae:

(1)

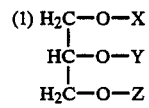

wherein at least one of X, Y and Z, is

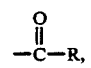

wherein R is alkyl, substituted alkyl, alkylene, or substituted alkylene, wherein alkyl or alkylene contains 1 to 100 carbon atoms, and at least one of X, Y and Z is selected from the group consisting of the free acid form, partially neutralized salt of the free acid, fully neutralized salt of the free acid, mono- or diester of the free acid,

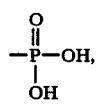

and combinations thereof;

(2) free acid form, partially neutralized salt of the free acid, fully neutralized salt of the free acid, or ester of the free acid,

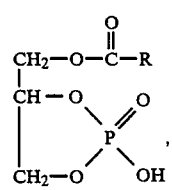

wherein R is defined as in (1) above;

(3) free acid form, partially neutralized salt of the free acid, fully neutralized salt of the free acid, or ester of the free acid,

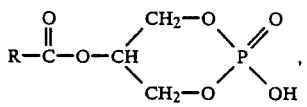

wherein R is defined as in (1) above; and mixtures of said glycerides.

3. A liquid electrostatic developer according to claim 2 wherein component (C) is a mixture of said glycerides.

4. A liquid electrostatic developer according to claim 2 wherein as component (C) there is also present at least one triglyceride of the formula:

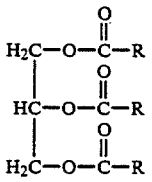

wherein R, which can be the same or different, is alkyl, substituted alkyl alkylene, or substituted alkylene wherein alkyl or alkylene contains 1 to 100 carbon atoms.

5. A liquid electrostatic developer according to claim 4 wherein the triglyceride is present in an amount of up to 95% by weight based on the total weight of component (C).

6. A liquid electrostatic developer according to claim 1 where the triglyceride is glyceryl trioleate.

7. A liquid electrostatic developer according to claim 2 wherein the glyceride is the barium salt of phosphoglyceryl dioleate.

8. A liquid electrostatic developer according to claim 2 wherein the glyceride is a salt of a phosphated mono- and diglyceride.

9. A liquid electrostatic developer according to claim 2 wherein the glyceride is the free acid form of glycerol monooleate cyclicphosphate.

10. A liquid electrostatic developer according to claim ,2 wherein component (A) is present in 85 to 99.98% by weight, component (B) is present in 0.02 to 15% by weight, component (C) is present in an amount of 0.1 to 10,000 mg/g developer solids the total weight of developer solids is 0.02 to 15% by weight.

11. A liquid electrostatic developer according to claim 2 containing up to about 60% by weight of a colorant based on the total weight of developer solids.

12. A liquid electrostatic developer according to claim 11 wherein the colorant is a pigment.

13. A liquid electrostatic developer according to claim 15 wherein the colorant is a dye.

14. A liquid electrostatic developer according to claim 2 wherein the thermoplastic resin is a copolymer of ethylene and an $\alpha,\beta$-ethylenically unsaturated ester selected from the group consisting of acrylic acid and methacrylic acid.

15. A liquid electrostatic developer according to claim 2 wherein the thermoplastic resin is a copolymer of ethylene (89%) methacrylic acid (11%) having a melt index at 190° C. of 100.

16. A liquid electrostatic developer according to claim 11 wherein the thermoplastic resin is a copolymer of ethylene (89%) methacrylic acid (11%) having a melt index at 190° C. of 100.

17. A liquid electrostatic developer according to claim 2 wherein the thermoplastic resin is a copolymer of acrylic or methacrylic acid and at least one alkyl ester of acrylic or methacrylic acid wherein alkyl is 1 to 20 carbon atoms.

18. A liquid electrostatic developer according to claim 2 wherein the thermoplastic resin is a copolymer of methyl acrylate, 50 to 90% by weight/methacrylic acid, 0 to 20% by weight/ethylhexyl acrylate, 10 to 50% by weight.

19. A liquid electrostatic developer according to claim 2 wherein the thermoplastic resin particles have an average by area particle size of less than 5 μm.

20. A liquid electrostatic developer according to claim 2 wherein an additional compound is present which is an adjuvant taken from the group consisting of polyhydroxy compound, aminoalcohol, polybutylene succinimide, metallic soap, and an aromatic hydrocarbon.

21. A liquid electrostatic developer according to claim 11 wherein an additional compound is present which is an adjuvant taken from the group consisting of polyhydroxy compound, aminoalcohol, polybutylene succinimide, metallic soap, and an aromatic hydrocarbon.

22. A liquid electrostatic developer according to claim 20 wherein a polyhydroxy adjuvant compound is present.

23. A liquid electrostatic developer according to claim 20 wherein an aminoalcohol adjuvant compound is present.

24. A liquid electrostatic developer according to claim 20 wherein a polybutylene succinimide adjuvant compound is present.

25. A liquid electrostatic developer according to claim 20 wherein a metallic soap adjuvant compound is present dispersed in the thermoplastic resin (B).

26. A liquid electrostatic developer according to claim 20 wherein an aromatic hydrocarbon adjuvant compound is present.

27. A liquid electrostatic developer according to claim 23 wherein the aminoalcohol adjuvant compound is triisopropanolamine.

28. A process for preparing liquid electrostatic developer for electrostatic imaging comprising A. dispersing at an elevated temperature in a vessel (1) a thermoplastic resin, and (2) a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, B. cooling the dispersion, either
   (1) without stirring to form a gel or solid mass, followed by shredding the gel or solid mass and grinding by means of particulate media;
   (2) with stirring to form a viscous mixture and grinding by means of particulate media; or
   (3) while grinding by means of particulate media to prevent the formation of a gel or solid mass;

C. separating the dispersion of toner particles having an average by area particle size of less than 10 μm from the particulate media, and D. adding to the dispersion during or subsequent to step (A) at least one glyceride charge director (3) of the formula

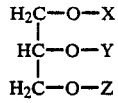

wherein each of X, Y and Z, which can be the same or different, is

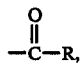

wherein R is an alkyl, substituted alkyl, alkylene or substituted alkylene wherein alkyl or alkylene contains 1 to 100 carbon atoms.

29. A process according to claim 28 wherein the glyceride charge director compound (3) is selected from the group consisting of a compound represented by the formulae:

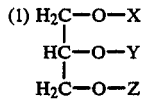

wherein at least one of X, Y and Z, is

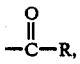

wherein R is alkyl, substituted alkyl, alkylene or substituted alkylene, wherein alkyl or alkylene contains 1 to 100 carbon atoms, and at least one of X, Y and Z is selected from the group consisting of the free acid form, partially neutralized salt of the free acid, fully neutralized salt of the free acid, mono- or diester of the free acid.

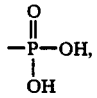

and combinations thereof;

(2) free acid form, partially neutralized salt of the free acid, fully neutralized salt of the free acid, ester of the free acid,

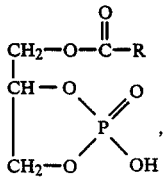

wherein R is defined as in (1) above;

(3) free acid form, partially neutralized salt of the free acid, fully neutralized salt of the free acid, or ester of the free acid,

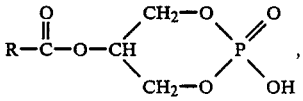

wherein R is defined as in (1) above; and mixtures of said glycerides.

30. A process according to claim 29 wherein the charge director (3) is a mixture of glycerides.

31. A process according to claim 29 wherein as component (3) there is also present at least one triglyceride of the formula:

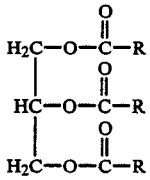

wherein R is an alkyl, substituted alkyl, alkylene or substituted alkylene, wherein alkyl or alkylene contains 1 to 100 carbon atoms.

32. A process according to claim 31 wherein the triglyceride is present in an amount of up to 95% by weight based on the total weight of the charge director (3).

33. A process according to claim 28 wherein the glyceride charge director is glyceryl trioleate.

34. A process according to claim 28 wherein the glyceride is the barium salt of phosphoglyceryl dioleate.

35. A process according to claim 29 wherein the glyceride is a salt of a phosphated mono- and diglyceride.

36. A liquid electrostatic developer according to claim 29 wherein the glyceride is the free acid form of glycerol monooleate cyclicphosphate.

37. A process according to claim 29 wherein additional liquid is added during or subsequent to step (B).

38. A process according to claim 37 wherein the additional liquid is selected from the group consisting of nonpolar liquid, polar liquid and combinations thereof.

39. A process according to claim 38 wherein the additional liquid is nonpolar liquid.

40. A process according to claim 39 wherein the additional nonpolar liquid reduces the concentration of resin particles to between 0.2 and 15% by weight with respect to the liquid.

41. A process according to claim 29 wherein cooling the dispersion is accomplished while grinding by means of particulate media to prevent the formation of a gel or solid mass.

42. A process according to claim 29 wherein cooling the dispersion is accomplished without stirring to form a gel or solid mass, followed by shredding the gel or solid mass and grinding by means of particulate media.

43. A process according to claim 29 wherein cooling the dispersion is accomplished with stirring to form a viscous mixture and grinding by means of particulate media.

44. A process according to claim 29 wherein up to about 60% by weight of a colorant based on the total weight of developer solids is added in step (A).

45. A process according to claim 44 wherein the colorant is a pigment.

46. A process according to claim 29 wherein the thermoplastic resin (1) is a copolymer of ethylene and an $\alpha,\beta$-ethylenically unsaturated ester selected from the group consisting of acrylic acid and methacrylic acid.

47. A process according to claim 29 wherein the thermoplastic resin is a copolymer of ethylene (89%) methacrylic acid (11%) having a melt index at 190° C. of 100.

48. A process according to claim 29 wherein the thermoplastic resin is a copolymer of acrylic or methacrylic acid and at least one alkyl ester of acrylic or methacrylic acid wherein alkyl is 1 to 20 carbon atoms.

49. A process according to claim 29 wherein the thermoplastic resin is a copolymer of methyl acrylate, 50 to 90% by weight/methacrylic acid, 0 to 20 % by weight/ethylhexyl acrylate, 10 to 50% by weight.

50. A process for preparing a liquid electrostatic developer comprising (A) dispersing in a thermoplastic resin a colorant and/or adjuvant in the absence of a dispersant nonpolar liquid having a Kauri-butanol value of less than 30 to form a solid mass.

(B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.02 to 15.0 percent by weight with respect to the liquid; and (F) adding to the dispersion during any of steps (C) to (E) or subsequent to step (E) a glyceride charge director compound of the formulae:

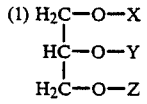

wherein X, Y and Z, which can be the same or different, is

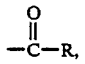

wherein R is an alkyl, substituted alkyl, alkylene or substituted alkylene, wherein the alkyl or alkylene substituent contains 1 to 100 carbon atoms, and at least one of X, Y and Z is selected from the group consisting of the free acid form, partially neutralized salt of the free acid, fully neutralized salt of the free acid, mono- or diester of the free acid,

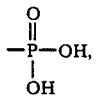

and combinations thereof;

(2) free acid form, partially neutralized salt of the free acid, fully neutralized salt of the free acid, or ester of the free acid,

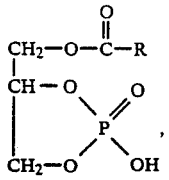

wherein R is defined as in (1) above;

(3) free acid form, partially neutralized salt of the free acid, fully neutralized salt of the free acid, or ester of the free acid,

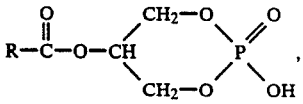

wherein R is defined as in (1) above; and mixtures of said glycerides.

51. A process for preparing a liquid electrostatic developer comprising (A) dispersing in a thermoplastic resin a colorant and/or adjuvant in the absence of a dispersant nonpolar liquid having a Kauri-butanol value of less than 30 to form a solid mass.

(B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin and colorant decomposes, (D) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(E) separating the dispersion of toner particles having an average by area particle size of less than 10 μm from the particulate media, and (F) adding additional nonpolar liquid, polar liquid or combinations thereof to reduce the concentration of toner particles to between 0.02 to 15.0 percent by weight with respect to the liquid; and (G) adding during any of steps (C) to (F) or subsequent to step (F) to the dispersion a glyceride charge director compound of the formulae;

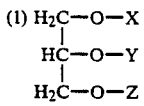

wherein at least one of X, Y and Z, is

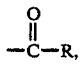

wherein R is alkyl, substituted alkyl, alkylene, or substituted alkylene, wherein alkyl or alkylene contains 1 to 100 carbon atoms, and at least one of X, Y and Z is selected from the group consisting of the free acid form, partially neutralized salt of the free acid, fully neutralized salt of the free acid, mono- or diester of the free acid,

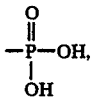

and combinations thereof:

(2) free acid form, partially neutralized salt of the free acid, fully neutralized salt of the free acid, or ester of the free acid,

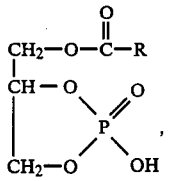

wherein R is defined as in (1) above;

(3) free acid form, partially neutralized salt of the free acid, fully neutralized salt of the free acid, or ester of the free acid,

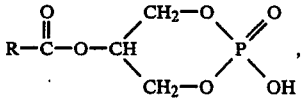

wherein R is defined as in (1) above; and mixtures of said glycerides.

52. A process according to claim 50 wherein the additional liquid is a polar liquid.

53. A process according to claim 51 wherein the additional liquid is a polar liquid.

* * * * *

UNITED STATES PATENT AND TRADEMARK OFFICE

CERTIFICATE OF CORRECTION

PATENT NO. : 4,886,726

DATED : DECEMBER 12, 1989

INVENTOR(S) : CHAN, et al.

It is certified that error appears in the above-identified patent and that said Letters Patent is hereby corrected as shown below:

| Col. | Line | | |
|---|---|---|---|
| 18 | 11-14 | $H_2C-O-X$<br>$HC-O-Y$<br>$H_2C-O-Z$ | Should Be $-\overset{O}{\overset{\|\|}{C}}-R$, |
| 19 | 46 | Between Claim and 2, delete the comma. | |
| 19 | 49 | After solids insert a comma. | |

Signed and Sealed this

Twenty-first Day of December, 1993

*Attest:*

*Attesting Officer*

Bruce Lehman

BRUCE LEHMAN

*Commissioner of Patents and Trademarks*